US005437076A

United States Patent [19]

Vasquez

[11] Patent Number: 5,437,076

[45] Date of Patent: Aug. 1, 1995

[54] TAMALE MASA SPREADER

[76] Inventor: Sandra P. Vasquez, 1205 Sixth St., Corpus Christi, Tex. 78404

[21] Appl. No.: 186,530

[22] Filed: Jan. 26, 1994

[51] Int. Cl.[6] ..... A47L 13/022

[52] U.S. Cl. ..... 15/236.05; 15/245.1; 30/124; 99/450.1

[58] Field of Search ..... 99/450.1, 494; 15/236.05, 236.06, 245.1, 235.4; 30/124, 125

[56] References Cited

U.S. PATENT DOCUMENTS

| | | | |
|---|---|---|---|
| D. 24,178 | 4/1895 | Hoffmann | D7/688 |
| D. 159,748 | 8/1950 | Mossel | D44/29 |
| D. 194,883 | 3/1993 | Mattar et al. | D44/29 |
| D. 228,055 | 8/1973 | Eisenhoffer | D7/4 |
| 2,094,703 | 10/1937 | Hitzman | 15/235.4 |
| 3,095,594 | 7/1963 | Dornbos | 15/235.4 |
| 3,341,878 | 6/1965 | Hubbard | 15/235.4 |
| 3,362,777 | 1/1968 | Keshock | 401/12 |
| 3,396,697 | 8/1968 | Bieser | 118/76 |
| 3,449,829 | 6/1969 | Mattinson | 30/124 |
| 3,545,873 | 12/1968 | Isaf | 401/98 |
| 3,652,171 | 3/1972 | Carlson | 401/12 |
| 3,735,487 | 5/1973 | Wojcik | 30/124 |
| 4,080,684 | 3/1978 | Venditti | 15/245.1 |
| 4,305,175 | 12/1981 | Burgess, Jr. | 15/236.06 |
| 4,364,145 | 12/1982 | Jones et al. | 15/236.01 |
| 4,364,145 | 12/1982 | Jones et al. | 15/245.1 |
| 4,766,635 | 8/1988 | DeVitis | 15/235.4 |
| 5,263,222 | 11/1993 | Johnstone, II | 15/236.06 |

*Primary Examiner*—David A. Scherbel
*Assistant Examiner*—Reginald L. Alexander

[57] ABSTRACT

A spreader for masa dough is disclosed having a generally U-shaped handle, a substantially flat rectangular base, and a pair of downwardly depending rectangular protrusions proximate two of the edges of the base. The protrusions are approximately ⅛ of an inch in thickness to allow the optimum thickness of masa to be spread on the corn husk. Additionally, each of the ends of the protrusions are beveled to allow for the smooth start of the spreading process.

7 Claims, 1 Drawing Sheet

TAMALE MASA SPREADER

BACKGROUND OF THE INVENTION

1. Field of the Invention

The present invention relates to cooking utensils. More specifically, it relates to a device that aids in spreading foodstuffs smoothly and evenly out on a surface. Even more specifically, it relates to a spreader for corn masa having a handle, a flat rectangular base, and including a pair of downwardly depending rectangular protrusions extending from the sides of the base to limit the width of the spreading.

In general, the disclosed invention is described as it relates to the field of culinary preparation although the device is applicable to any task in which is is desired to manually spread a pasty substance in a layer to a uniform thickness on a supporting surface. For example, the applying of mortar paste in the construction field would occur to the artisan.

Thus it can be seen that the potential fields of use for this invention are myriad and the particular preferred embodiment described herein is in no way meant to limit the use of the invention to the particular field chosen for exposition of its details.

A comprehensive listing of all the possible fields to which this invention may be applied is limited only by the imagination and is therefore not attempted here. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

Tamales have been known for centuries in Mexico. Contemporary historians present during the conquest of Mexico reported several varieties of the foodstuff. Tamales are made by spreading a thick paste of masa harina (corn that has been treated by unslaked lime) and, in most cases, adding a filling of meat, vegetables, and the like on top of that. The resulting product is then wrapped in the outer husk, tied or otherwise secured, and then steamed until done. In the process of preparing this dish, one of the more time consuming parts of the operation is the spreading of the masa flour on the corn husk. Traditionally, this is accomplished by spreading the masa with a spoon over the husk. This has a number of drawbacks, not the least being that some considerable experience is helpful to spread the masa evenly and quickly. Even with experience, transferring spoonfuls at a time and trying to keep the layer of masa even is difficult. The present invention was developed to allow for quicker and easier spreading of the masa flour on the husk. It allows for inexperienced people who wish to try and make the dish at home to attempt to do so. It also allows for children, who might wish to aid their families in meal preparation, to assist in the tamale making process. Even experienced tamale makers would benefit from a spreader that allows the entire operation to be accomplished with one stroke, and keeps the layer of masa at the optimum depth and completely even across the corn husk.

A number of U.S. Patents that relate to spreaders or scrapers for various materials were uncovered during the course of a search and they are discussed hereinafter:

In U.S. Pat. No. 3,341,878 issued on Sep. 19, 1967 to Joel D. Hubbard there is disclosed a hand finishing tool. This has a flexible flat face and rib. Unlike applicant's present invention, there are no downwardly depending protrusions taught or disclosed.

In U.S. Pat. No. 3,362,777 issued on Jan. 9, 1968 to Edward G. Keshock there is disclosed a butter applicator. This is also clearly unlike applicant's invention, having a rectangular, hollow body with an open corner.

U.S. Pat. No. 3,396,697 issued on Aug. 13, 1968 to Carl O. Beiser discloses a corn buttering device. A pedestal is mounted on a base, with the pedestal having an arcuate top adapted to receive butter. The user can move a piece of corn back and forth over the top of the pedestal to butter it. This clearly is dissimilar to applicant's invention.

U.S. Pat. No. 3,449,829 issued on Jun. 17, 1969 to Thomas Mattison discloses a butter spreader wherein a blade with chamfered edges is attached to a handle. The blade width is approximately the same size as that of a standard quarter pound stick of butter. There is little similarity with the present invention.

In U.S. Pat. No. 3,545,873 issued to Asad F. Isaf on Dec. 8, 1970 discloses a butter storing and spreading package. In contrast with applicant's invention, there are no depending protrusions to limit the dispensed or carried substance's sideward spread.

U.S. Pat. No. 3,652,171 issued on Mar. 28, 1972 to John W. Carlson discloses a butter applicator. This device includes a generally rectangular body with inwardly and downwardly turned interior edges that hold the stick of butter in relation to the cob being buttered. The lack of a taught handle, base, or depending protrusions clearly differentiate this from applicant's present invention.

U.S. Pat. No. 3,735,487 issued to Joseph D. Wojcik on May 29, 1973 shows a corn-on-the-cob butterer. This has a handle and a convex surface carrying a plurality of bristles that engage the butter and allow the user to spread it on an ear of corn. Unlike applicant's present invention, there is no generally flat base portion taught.

U.S. Pat. No. 4,364,145 issued on Dec. 21, 1982 to John F. Jones et al. discloses a scraping tool. This device has a flat base, and a plurality of V-shaped scraping elements disposed on the bottom thereof. Additionally, there is a T-shaped handle for the manipulation of the device. The apparatus is seen to be dissimilar from applicant's invention.

U.S. Pat. No. 4,766,635 issued on Aug. 30, 1988 to Louis DeVitis discloses an interior-edge edger. In this device there is seen a flat rectangular plate with one of the longer edges having a downwardly and outwardly depending central portion. This is in contrast to applicant's invention wherein a pair of depending protrusions are located on two sides of the device's base.

Additionally, the following U.S. design patents were uncovered, but it will be seen by examination that none of the ornamental appearances shown anticipate the present invention:

U.S. Pat. Nos. D159,748 issued on Aug. 15, 1950 to Max N. Mossel; D194,883 issued on Mar. 26, 1963 to Paul F. Mattar; D228,055 issued on Aug. 7, 1973 to Joseph T. Eisenhoffer. None of the above inventions and patents, taken either singly or in combination, is seen to describe the instant invention as claimed.

SUMMARY OF THE INVENTION

The present invention is a spreader for masa dough having a generally U-shaped handle, a substantially flat base, and a pair of downwardly depending rectangular protrusions proximate two of the edges of the base. The protrusions are approximately ⅛ of an inch in thickness to allow the optimum thickness of masa to be spread on the corn husk. Additionally, each of the ends of the protrusions are beveled to allow for the smooth start of the spreading process.

Accordingly, it is a principle object of the invention to provide a tamale masa spreader where the masa can be spread on a corn husk with a single stroke.

It is another object of the invention to provide a tamale masa spreader where the two depending protrusions from the base of the device are of the correct thickness to allow for the optimum depth of spread masa.

It is a further object of the invention to provide a tamale masa spreader wherein the flat base of the device can be used to scoop up the masa to be spread.

Still another object of the invention is to provide a tamale masa spreader so that even a person who has no experience in the making of tamales can utilize it.

It is a major goal of the invention to provide improved elements and arrangements thereof in an apparatus for the purposes described which is inexpensive, dependable and fully effective in accomplishing its intended purposes.

It is submitted that the present invention meets or exceeds all the above objects and goals. Upon further study of the specification and appended claims, further objects and advantages of this invention will become apparent to those skilled in the art.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENT

Figure 1:
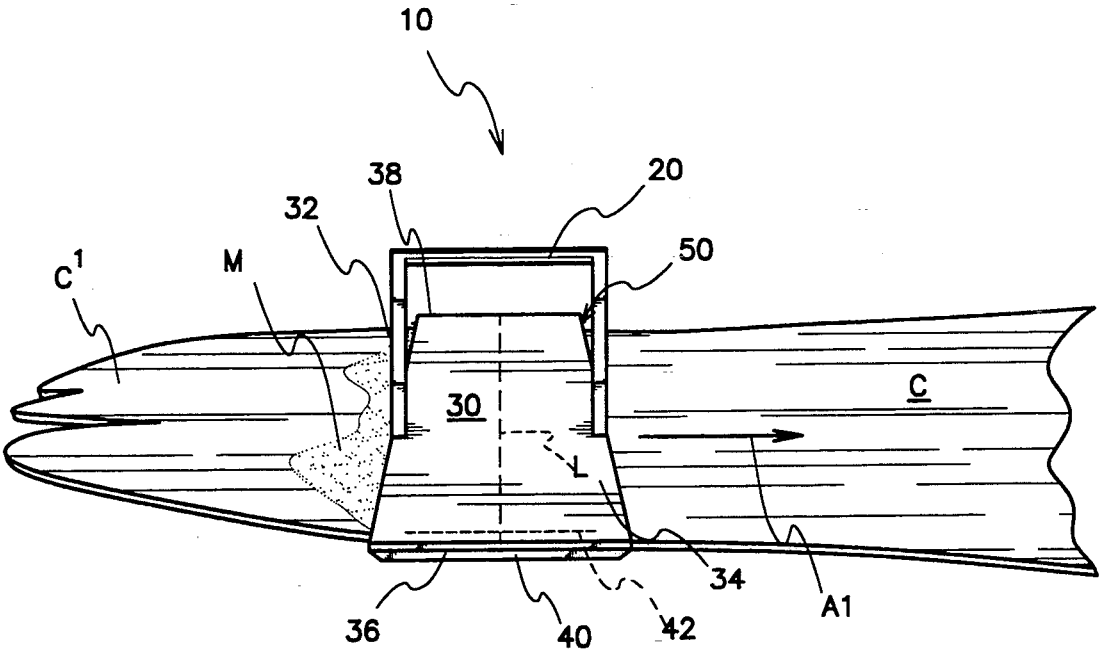
FIG. 1 is an environmental perspective view of the device in use.

The present invention is generally indicated in the figures as 10. The device has a handle 20, a base 30, and a pair of downwardly depending protrusions 40, 50. The handle 20, in the preferred embodiment, is generally U-shaped and open to allow for easy gripping and manipulation by the user, as well as ease in cleaning. The base 30 has a front end 32, a rear end 34 and two parallel sides 36, 38. The front and back ends 32, 34 are approximately five inches in length and the two sides 36, 38 are approximately four inches long. Applicant has discovered that these dimensions allow for efficient covering of the standard corn husk C (shown in FIG. 1). Depending from the bottom side of the base 30, that is, the side opposite that from which the handle 20 extends, are a pair of generally rectangular protrusions 40, 50. The dotted line 42 in FIG. 1 gives an idea of the width of the protrusion 40. Though the details of the protrusion 50 are not shown, it should be understood that they are substantially identical to those of protrusion 40. Equidistant from the front end 32 and the rear end 34 is a transverse axis L, seen in FIG. 1. The material that the device is made from is not critical, however a polymer material would seem to be preferred for ease and low cost in manufacturing, as well as easy cleaning in a dishwasher or the like. Of course, for commercial purposes, stainless steel could be used.

Figure 2:
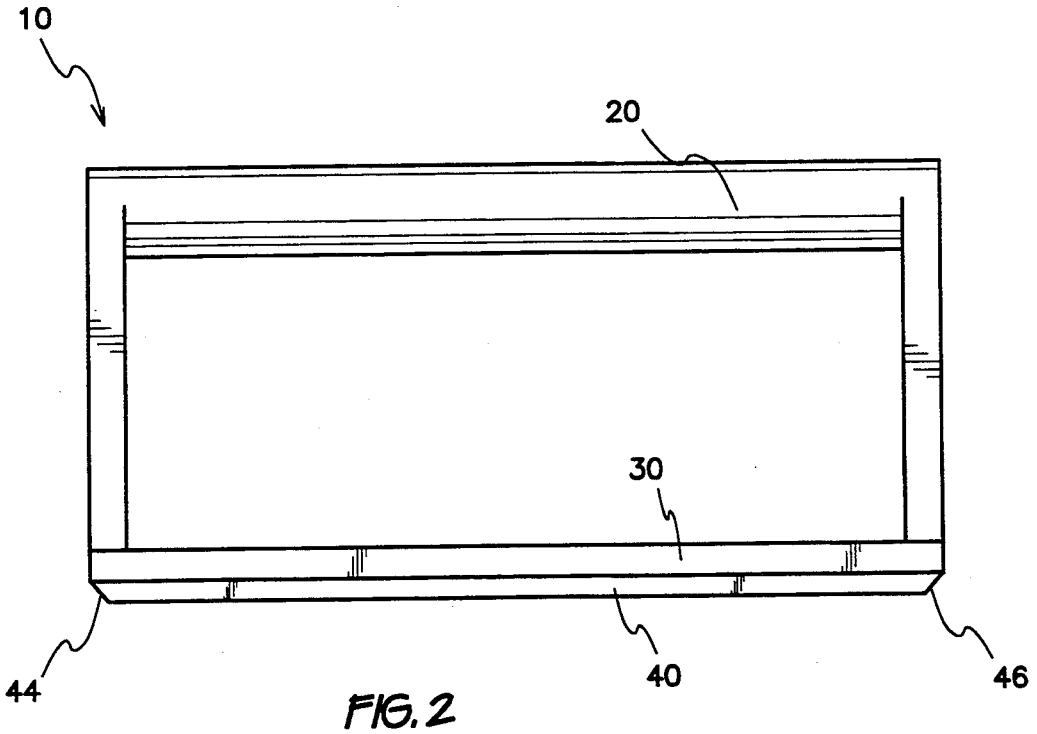
FIG. 2 is a side view of the device showing the details of the depending protrusions and the beveled edges thereon.

Referring now to FIG. 2, it can be seen that at each of the ends 44, 46 of the protrusion 40 there is a bevel or chamfer. The bevels or chamfers 44, 46 are formed such that each of the ends of the depending protrusion 40 taper towards the transverse axis L. These bevels 44, 46 serve to ease the start of the spreading process and guide the masa to one side or another of the protrusions 40, 50. As was discussed above, though the details of the protrusion 50 are not shown in the figures, it should be understood that they are substantially the same as those discussed for protrusion 40. Thus it can be seen that the protrusions 40, 50 are of equal height as they depend from base 30. Another important aspect of the protrusions 40, 50 is their thickness, or the distance that they depend from the bottom of the base 30. Applicant has determined that a distance of approximately ⅛ of an inch is optimum for the spreading of the masa.

The use of the device is simple. Masa is scooped onto the bottom of the base 30 of the device 10 and the corn husk C is held at the top C′ with the silky side up, as is known in the tamale making art. The device is then gently pressed down and, held at an angle of approximately 30° from the longitudinal axis of the husk C and flat in relation thereto, the device 10 is moved in the direction indicated by arrow A1 in FIG. 1. Thus a smooth layer of masa (as indicated by M in FIG. 1) covers the surface of the husk C and filling can then be added, the whole foodstuff rolled up, sealed, and cooked.

Thus it will be seen that an uncomplicated yet effective paste spreading device has been disclosed which meets or exceeds the aforementioned objects and goals. From the foregoing description, one skilled in the art can easily ascertain the essential characteristics of this invention and, without departing from the spirit and scope thereof, can make various changes and modifications of the invention to adapt it to various usages and conditions. It is to be understood that the present invention is not limited to the sole embodiment described above, but encompasses any and all embodiments within the scope of the following claims.

I claim:

1. A spreader for masa comprising;

a substantially flat base having two generally parallel edges, a top side, a bottom side, and with a transverse axis extending between said parallel edges proximate the midpoint of each of said parallel edges;

handle means attached to said top side of said base;

a pair of depending protrusions disposed on said bottom side of said base, said depending protrusions being located proximate each of said parallel edges, each of said protrusions having two distal ends, and each of said distal ends of each of said depending protrusions being downwardly tapered toward said transverse axis, and further where each said depending protrusion is substantially the same height as the other said depending protrusion.

2. The spreader according to claim 1, wherein said base further includes a front edge and a back edge, said front and back edges being generally perpendicular to said parallel edges, and where each of said depending protrusions extend substantially entirely from said front edge to said back edge.

3. The spreader according to claim 1, wherein said handle means is a generally U-shaped member.

4. The spreader according to claim 3, wherein said U-shaped member is disposed generally parallel to said parallel edges of said base.

5. The spreader according to claim 1, wherein the depending protrusions each extend approximately one-eighth of an inch from said bottom of said base.

6. The spreader according to claim 1, wherein said spreader is made of a polymer material.

7. The spreader according to claim 1, wherein the device is made from stainless steel.

* * * * *